US010273764B2

(12) United States Patent
Bergeron et al.

(10) Patent No.: US 10,273,764 B2
(45) Date of Patent: Apr. 30, 2019

(54) METHOD OF RUNNING A PASSIVELY MOTION COMPENSATED TUBING HANGER RUNNING TOOL ASSEMBLY

(71) Applicant: Chevron U.S.A. Inc., San Ramon, CA (US)

(72) Inventors: Henry Bergeron, Houston, TX (US); Dave Barrow, Katy, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/254,774

(22) Filed: Sep. 1, 2016

(65) Prior Publication Data

US 2018/0058156 A1 Mar. 1, 2018

(51) Int. Cl.
*E21B 17/07* (2006.01)
*E21B 19/00* (2006.01)

(52) U.S. Cl.
CPC ..... *E21B 17/07* (2013.01); *E21B 19/002* (2013.01)

(58) Field of Classification Search
CPC ..... E21B 17/07; E21B 17/01; E21B 23/02; E21B 33/043; E21B 33/064; E21B 33/12; E21B 34/06; E21B 47/1025; E21B 47/12
USPC ..... 166/337
See application file for complete search history.

(56) References Cited

U.S. PATENT DOCUMENTS 1,813,402 A 7/1931 Hewitt
2,124,015 A 7/1938 Fredrick
2,606,003 A 8/1952 McNeil
3,643,751 A 2/1972 Crickmer
4,077,472 A * 3/1978 Gano ..... E21B 23/06 166/125
4,118,954 A 10/1978 Jenkins
4,466,487 A 8/1984 Taylor, Jr.
4,979,568 A 12/1990 Spencer, III
6,913,092 B2 7/2005 Bourgoyne
7,301,472 B2 11/2007 Kyle
7,926,578 B2 4/2011 Moffitt
8,720,578 B2 5/2014 Allensworth
8,727,012 B2 5/2014 Bhat
9,033,051 B1 5/2015 Lugo
9,133,670 B2 9/2015 Cain
9,187,973 B2 11/2015 Cain
9,376,872 B2 6/2016 June
2004/0000406 A1* 1/2004 Allamon ..... E21B 21/103 166/373
2009/0101345 A1 4/2009 Moffitt
2011/0278013 A1 11/2011 Allensworth
(Continued)

OTHER PUBLICATIONS

"Surface BOP System for Subsea Development Offshore Brazil in 1,900m of Water"; Brian Tarr, et al., Orlando, Florida; Mar. 2008. Society of Petroleum Engineers.

(Continued)

*Primary Examiner* — Matthew R Buck
*Assistant Examiner* — Patrick F Lambe
(74) *Attorney, Agent, or Firm* — King & Spalding LLP

(57) ABSTRACT

A method of running a tubing hanger and upper completion using a passively motion compensated tubing hanger running tool assembly in a subsea well located at a sea floor is described. Methods include using a tubing hanger running tool assembly comprising a tubing hanger running tool and a pressure containing slip joint to provide passive heave compensation.

28 Claims, 8 Drawing Sheets

(56) References Cited

U.S. PATENT DOCUMENTS

| | | | |
|---|---|---|---|
| 2015/0096766 | A1 | 4/2015 | White |
| 2015/0259990 | A1 | 9/2015 | June |

OTHER PUBLICATIONS

"Deepwater Christmas Tree Development", PP Alfano, et al, Houston, Texas, May 1989. Offshore Technology Conference.
"A Simple and Affordable Heave Compensated Landing System" Mitch Guinn, et al. Houston, Texas, May 2003; Offshore Technology Conference.

* cited by examiner

METHOD OF RUNNING A PASSIVELY MOTION COMPENSATED TUBING HANGER RUNNING TOOL ASSEMBLY

TECHNICAL FIELD

The present application is generally related to a method of running a passively motion compensated tubing hanger running tool assembly which comprises a pressure containing slip joint.

BACKGROUND

During the upper completion process on subsea drilled and lower completed wells, the tubing hanger, which suspends the production tubing in the subsea production tree, is locked into the tree or wellhead. Numerous time-consuming operations such as flowing back the well, testing the well, testing the intelligent well equipment, plugging the well, etc. can occur after the tubing hanger is locked in place. These operations occur from a floating rig which heaves (moves up and down) with the sea waves and currents. The floating rig must rely on its derrick based compensation system during this period when the tubing hanger, tubing, and associated equipment are locked into a stationary structure, such as the tree or wellhead, on the seafloor. The tubing hanger and associated equipment can be over-stressed, damaged or even pulled apart if the compensation system fails when the rig moves. Further, the process of landing the tubing hanger is difficult, as it must be done fairly delicately and, once landed, it may be necessary to keep the landing tool in place for several days.

Compensation systems can be active or passive. Active systems, such as are effected through the rig drawworks or top drive, are powered by the rig, and passive systems are independent of rig power. The active compensation system will lose functionality when the rig loses power, while a passive system will continue to function during a power loss. Loss of heave compensation can cause stress and/or parting to the landing string and/or the associated running equipment. Most derrick based compensation systems that hold the tubing are actively compensated and, as such, a risk exists when the tubing running hanger tool is attached to a locked tubing hanger should a power loss condition occur.

As shown in FIG. 1, within a subsea well completion system 100, a passive compensated coil tubing lift frame (CCTLF) 102 can be installed into the derrick to hold the tubing at surface when installing the tubing hanger and locking it into the tree in order to mitigate risk. A CCTLF 102 has nitrogen filled cylinders that go up and down and provide passive heave compensation. A CCTLF 102 is typically installed for longer connection periods. A CCTLF 102 is a massive piece of equipment that is costly to install, test, and operate. A CCTLF 102 is suspended from the rig elevator and drawworks system incorporating 'weak link bails' designed to fail before encountering an overpull. Additionally, many operators will use a subsea test tree (SSTT) 104 internal to a subsea BOP 106 during the tubing hanger installation process. The SSTT 104 is operated by hydraulic lines, such as an inner umbilical 116, running on the outside of the landing string 108 to the sea surface and contains a set of valves. The landing string 108 runs on the inside of the marine riser 110. The subsea BOP 106 can be closed around the SSTT 104 allowing access of the choke and kill lines to the well at the subsea BOP 106. The SSTT 104 also has functionality to separate below the blind/shear rams 112 to allow disconnection from the subsea well 114 should the need arise. The SSTT 104 must be 'in tension' by locking the tubing hanger and applying an upward pull through the landing string 108, to function correctly. An in-riser umbilical or inner umbilical 116 can control downhole functions such as surface controlled subsurface safety valve (SCSSV), intelligent well completion accessories (IWC), and/or electrical submersible pump (ESP). An IWOCS umbilical 118 for installation and workover control system (IWOCS) runs outside of the riser and can convey temporary controls to the tree, to which downhole control and telemetry functions are transferred.

Current methods can take 10-12 days to simply run an upper completion into a well and land a tubing hanger in place. This long period of time is mostly due to the need for passive heave compensation. Thus, a new passive motion compensated assembly, system, and process for landing tubing can save time and reduce cost.

SUMMARY

A general embodiment of the disclosure is a tubing hanger running tool assembly. The tubing hanger running tool assembly comprises a pressure containing slip joint comprising an inner mandrel and an outer mandrel located concentrically such that the inner mandrel and outer mandrel can slide relative to each other providing compression and extension along a linear axis and comprising pressure containing seals located between the inner and outer mandrels, and a tubing hanger running tool coupled to the pressure containing slip joint. The tubing hanger running tool assembly can additionally comprise one or more of an integral internal test tool, a ported slip joint, a shearable joint, a spacer, or combinations thereof. Tools, spacers, valves, and joints within the pressure combining slip joint can be arranged in any combination, as long as the tubing hanger running tool is located on one end. For example, an integral internal test tool can be located between the tubing hanger running tool and the pressure containing slip joint, a pressure containing slip joint can be located between a ported slick joint and the tubing hanger running tool, and/or a pressure containing slip joint can be located between the shearable joint and the tubing hanger running tool. The pressure containing slip joint can comprise a latching mechanism configured to stop the compression and extension of the slip joint, such as one or more of a shear pin, a J-latch, hydraulic pistons, indexing nubs and channels, and combinations thereof. Additionally, the pressure containing slip joint can comprise an outside shroud configured to house an inner umbilical along the exterior of the pressure containing slip joint. In some embodiments of the disclosure, the pressure containing slip joint has 3-35 feet of extension and compression. Further, the slip joint can be coupled to the tubing hanger running tool with either the inner mandrel or the outer mandrel coupled closest to the tubing hanger running tool. In some embodiments of the disclosure, the pressure containing slip joint is between 4-44 feet long. In some embodiments of the disclosure, the tubing hanger running tool assembly is between 5-45 feet long. The tubing hanger running tool assembly can additionally comprise a tubing retainer valve and/or a valve capable of shearing wireline or coiled tubing.

Another general embodiment of the disclosure is a passively motion compensated subsea well system comprising: (a) a marine riser suspended below the rig floor, coupled to a containment device, (b) a wellhead assembly coupled to the containment device proximate to the top of the wellhead assembly, and (c) a tubing hanger running tool assembly suspended inside of one or more of the marine riser and the containment device from an upper tubing, the tubing hanger running tool assembly comprising: a pressure containing slip joint comprising an inner mandrel and an outer mandrel located concentrically such that the inner mandrel and outer mandrel can slide relative to each other providing compression and extension along a linear axis and comprising pressure containing seals located between the inner and outer mandrels, and a tubing hanger running tool. In some embodiments of the disclosure, the containment device is a MCD or a BOP. In specific embodiments of the disclosure, the containment device is a MCD and further comprises a surface BOP. Additionally, the upper tubing can be drill pipe, landing string, or the like. The tubing hanger running tool assembly can additionally comprise one or more of an integral internal test tool, a ported slip joint, a shearable joint, a spacer, or combinations thereof. Tools, spacers, valves, and joints within the pressure containing slip joint can be arranged in any combination, as long as the tubing hanger running tool is located on one end. For example, an integral internal test tool can be located between the tubing hanger running tool and the pressure containing slip joint, a pressure containing slip joint can located between a ported slick joint and the tubing hanger running tool, and/or a pressure containing slip joint is located can be located between the shearable joint and the tubing hanger running tool. The pressure containing slip joint can comprise a latching mechanism configured to stop the compression and extension of the slip joint, such as one or more of a shear pin, a J-latch, hydraulic pistons, indexing nubs and channels, and combinations thereof. Additionally, the pressure containing slip joint can comprise an outside shroud configured to house an inner umbilical along the exterior of the pressure containing slip joint. In some embodiments of the disclosure, the pressure containing slip joint has 3-35 feet of extension and compression. Further, the slip joint can be coupled to the tubing hanger running tool with either the inner mandrel or the outer mandrel coupled closest to the tubing hanger running tool. In some embodiments of the disclosure, the pressure containing slip joint is between 4-44 feet long. In some embodiments of the disclosure, the tubing hanger running tool assembly is between 5-45 feet long. The tubing hanger running tool assembly can additionally comprise a tubing retainer valve and/or a valve capable of shearing wireline or coiled tubing. In specific embodiments, a ported slick joint is located inside of the containment device when the tubing hanger running tool assembly is landed. The system can further comprise an annulus pressure test device located between the marine riser and the containment device. In some embodiments, the system further comprises a tubing hanger attached to the lower end of the tubing hanger running tool assembly. In specific embodiments, the system further comprises an upper completion attached to the lower end of the tubing hanger. The upper completion can comprise one or more of production tubing, seal assemblies, downhole control and monitoring devices, safety tools, and packers, for example. In specific embodiments, the tubing hanger is sealed and locked to the wellhead assembly. The wellhead assembly can comprise a HXT and/or a high pressure wellhead. Another general embodiment of the disclosure is a method of running a tubing hanger and upper completion using a passively motion compensated tubing hanger running tool assembly in a subsea well located at a sea floor comprising (a) assembling an inner string comprising, from bottom up: (1) an upper completion assembly comprising one or more of the following parts: production tubing, seal assemblies, safety valves, and packers, (2) a tubing hanger, (3) a tubing hanger running tool assembly comprising a tubing hanger running tool coupled to a pressure containing slip joint; and (3) an upper tubing; and (b) lowering the inner string into a marine riser until the tubing hanger is landed on a casing load shoulder proximate the sea floor; and (c) actuating the tubing hanger running tool assembly to seal the tubing hanger to a wellhead assembly. Additionally, the upper tubing can be drill pipe, landing string, or the like. The tubing hanger running tool assembly can additionally comprise one or more of an integral internal test tool, a ported slip joint, a shearable joint, a spacer, or combinations thereof. Tools, spacers, valves, and joints within the pressure containing slip joint can be arranged in any combination, as long as the tubing hanger running tool is located on one end. For example, an integral internal test tool can be located between the tubing hanger running tool and the pressure containing slip joint, a pressure containing slip joint can located between a ported slick joint and the tubing hanger running tool, and/or a pressure containing slip joint is located can be located between the shearable joint and the tubing hanger running tool. The pressure containing slip joint can comprise a latching mechanism configured to stop the compression and extension of the slip joint, such as one or more of a shear pin, a J-latch, hydraulic pistons, indexing nubs and channels, and combinations thereof. In some embodiments, the slip joint is immobilized by the latching mechanism as the string of tools is lowered. In specific embodiments, just prior, during, or just after landing, the latching mechanism is released. Additionally, the pressure containing slip joint can comprise an outside shroud configured to house an inner umbilical along the exterior of the pressure containing slip joint. In some embodiments of the disclosure, the pressure containing slip joint has 3-35 feet of extension and compression. Further, the slip joint can be coupled to the tubing hanger running tool with either the inner mandrel or the outer mandrel coupled closest to the tubing hanger running tool. In some embodiments of the disclosure, the pressure containing slip joint is between 4-44 feet long. In some embodiments of the disclosure, the tubing hanger running tool assembly is between 5-45 feet long. The tubing hanger running tool assembly can additionally comprise a tubing retainer valve and/or a valve capable of shearing wireline or coiled tubing. In specific embodiments, a ported slick joint is located inside of the containment device when the tubing hanger running tool assembly is landed. The system can further comprise an annulus pressure test device located between the marine riser and the containment device. In some embodiments, an inner umbilical is attached to the outside of the inner string as it is being assembled. The inner umbilical can be used to actuate the tubing hanger, testing tools, and to transmit and/or receive testing input and data, for example. After actuating the tubing hanger, the seal of the tubing hanger can be tested, for example, by using one or more of a BOP, an integral internal test tool, annular pressure test tool, and combinations thereof. The method can additionally include setting one or more plugs and backpressure valves within the inner string using a wireline and can further include testing the one or more plugs and backpressure valves. The method can further include actuating parts of the upper completion. After actuating the tubing hanger, the tubing hanger can be disconnected from the tubing hanger running tool assembly. After disconnection, the tubing hanger running tool assembly can be pulled back up to a rig and the rig can also be moved away from the well. Prior to disconnecting the tubing hanger running tool assembly from the tubing hanger, the pressure containing slip joint can be latched to immobilize the compression and extension of the slip joint. In some embodiments of the disclosure, the wellhead assembly comprises a HXT and/or a high pressure wellhead. In some embodiments, the tubing hanger has crown plugs installed during the assembly of the inner string. In some embodiments, a containment device is attached between the wellhead assembly and the marine riser proximate the sea floor, such as a BOP or a MCD. If an MCD is installed subsea, a surface BOP may also be installed.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
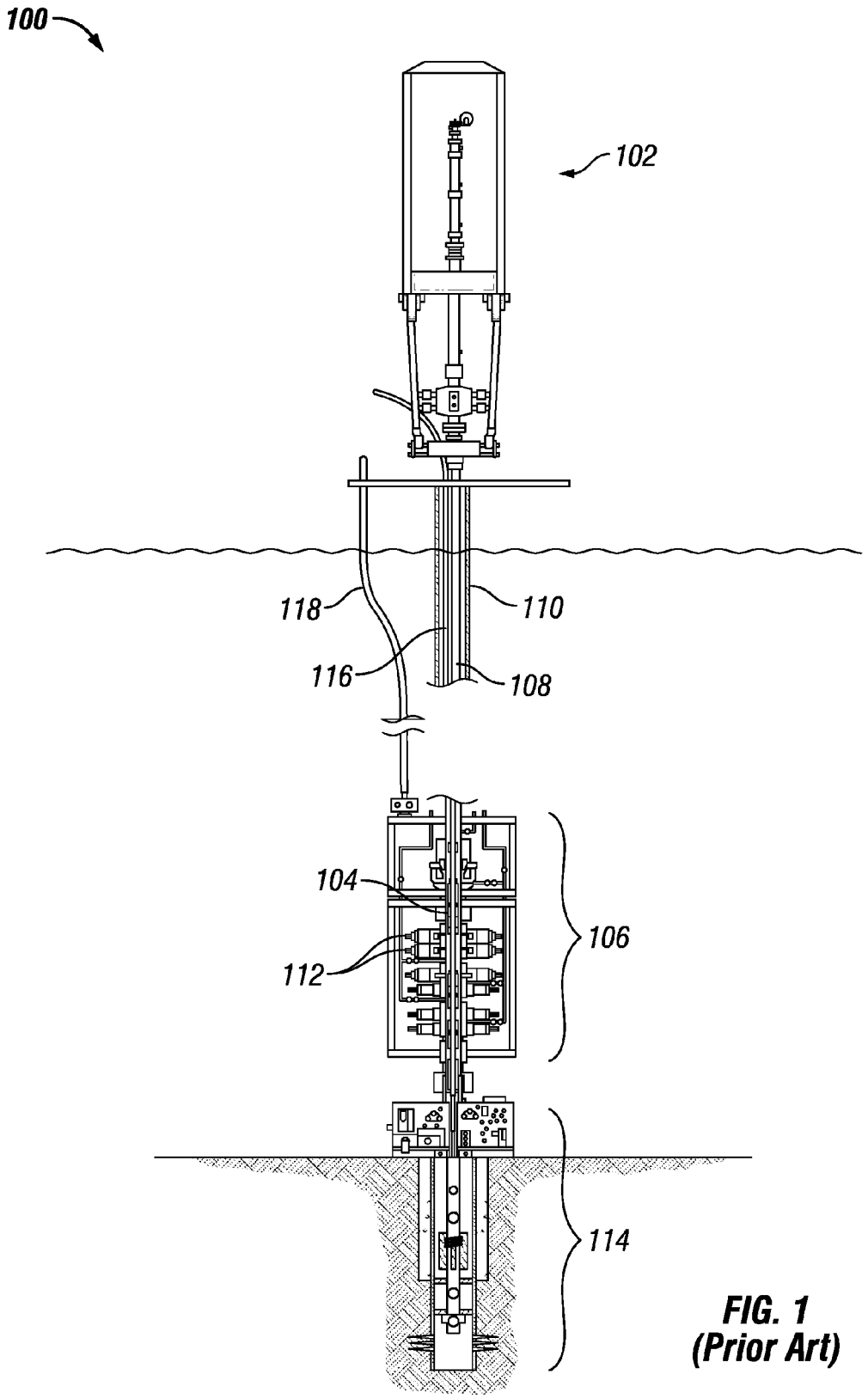
FIG. 1 (Prior Art)
FIG. 1 illustrates a well completion system of the prior art.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

The present disclosure may be better understood by reading the following description of non-limiting embodiments with reference to the attached drawings wherein like parts of each of the figures are identified by the same reference characters. The words and phrases used herein should be understood and interpreted to have a meaning consistent with the understanding of those words and phrases by those skilled in the relevant art. No special definition of a term or phrase, for example, a definition that is different from the ordinary and customary meaning as understood by those skilled in the art, is intended to be implied by consistent usage of the term or phrase herein. To the extent that a term or phrase is intended to have a special meaning, for instance, a meaning other than that understood by skilled artisans, such a special definition is expressly set forth in the specification in a definitional manner that directly and unequivocally provides the special definition for the term or phrase.

Acronyms

CCTLF—compensated coiled tubing lift frame
SSTT—subsea test tree
IWOCS—installation and workover control system
BOP—blow out preventer
THRT—tubing hanger running tool
SCSSV—surface controlled subsurface safety valve
IWC—intelligent well completion
MCD—mudline closure device
TH—tubing hanger
THS—tubing head spool
VXT—vertical Christmas tree
HXT—horizontal Christmas tree
ESP—electric submersible pump
ITC internal tree cap
ROV—remotely operated vehicle

Definitions

As used herein, a "slip joint" refers to a pressure containing and pressure balancing slip joint. That is, the slip joint comprises seals which isolate the outside of the slip joint from the interior of the slip joint. A slip joint comprises an outer mandrel and an inner mandrel located inside of the outer mandrel (arranged concentrically), wherein the inner and outer mandrel are configured to slide relative to each other allowing extension and compression of the slip joint along a linear path. Sealing elements between the mandrels provide pressure containment. In some embodiments, the inner mandrel is also rotatable within the outer mandrel.

A "tubing hanger running tool assembly" of the disclosure comprises at least a tubing hanger running tool and a slip joint.

A "containment device" as used herein, refers to a device that is used to shut off flow within a pipe. Examples of containment devices are BOPs and MCDs. The containment device may have additional uses, but must have a method to shut off flow of a liquid and/or gas within a tube.

"Coupling" or "coupled," as used herein, refers to a method of attaching two tools within a string of tools together. The two tools may be coupled together with other tools intervening between them or directly attached to each other.

"Attaching" or "attached," as used herein, refers to a method of attaching two tools together where there are no other tools between the two tools. However, attachment mechanisms such as bolts, spacers, and/or spools may be located between the tools.

"Lower completion," as used herein, typically refers to the bottom area of the well that comprises the production or injection zone, and the associated equipment such perforations, screens, blank pipe and packers, required to connect the zone with the inside of the well.

"Upper Completion," as used herein, refers to the tubing and tools attached to a string and which, when landed, are located below the wellhead and inside of the well casing, but above the production zone and lower completion. Upper completion can include one or more of production tubing, intelligent well accessories, ESPs, flow control devices including surface controlled subsurface safety valves, control lines, artificial lift and/or safety accessories including those for formation isolation. Upper completion comprises tubing and all of the hardware that needs to connect to the lower completion in order to produce the well into the subsea tree and into a production facility. When landed, the upper completion is hung from the tubing hanger, which is attached to the tree, tubing head spool or wellhead.

As used herein "internal umbilical" or "inner umbilical" refers to an umbilical assembly that includes one or more control lines and is run though the annulus of a marine riser 110, usually attached to the outside of the landing string 108. That is, the inner umbilical 116 is internal to the marine riser 110, but external to the inner string.

"Landed" or "landing," as used herein, refers to the final positioning of tools or string, such as the tubing hanger running tool assembly. In most embodiments, landed refers to when the tubing hanger has been landed on the casing load shoulder and orientation sleeve. The tubing hanger may or may not be sealed to the tree at the time, while still being attached to the tubing hanger running tool assembly.

"Tree" or "subsea tree" as used herein refers to a HXT or VXT that is located on the sea floor.

"Inner string," as used herein, is the string that is run inside of the marine riser 110. The string can comprise tools and tubing. The inner string can comprise landing tools and tubing as well as the tubing hanger. The inner string generally has a free inside diameter that allows for the flow of liquid or gas.

"Upper tubing," as used herein, refers to the tubing that runs from just below the rig floor to the top of the tubing hanger running tool assembly. The upper tubing can be drill pipe or landing string, for example.

"Wireline," as used herein, refers to a line, (including either a single strand of metal wire, or a combination of strands including one or more electrical conductors) that is run inside of the inner string. The wireline is not tubing, but instead is a line that is used to run tools or plugs into and out of the inner string.

"Wellhead assembly," as used herein, can include one or more of a tree, tubing head spool, wellhead, and combinations thereof.

The devices and methods of the present application include a tubing hanger running tool assembly comprising a pressure containing slip joint and a tubing hanger running tool; a passive motion compensated subsea well completion system comprising the tubing hanger running tool assembly, and a method of running a tubing hanger using a passive motion compensated tubing hanger running tool in a subsea well located at a sea floor. The assembly, system, and method enable streamlined and less expensive upper completion installation. The system will deliver passive heave compensation and in some embodiments disconnect and reconnect capability through the tubing hanger running tool assembly. Additionally, as the tubing hanger running tool assembly described herein provides passive heave compensation, a CCTLF 102 is unneeded.

Illustrative embodiments of the disclosure are described below. In the interest of clarity, not all features of an actual implementation are described in this specification. One of ordinary skill in the art will appreciate that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
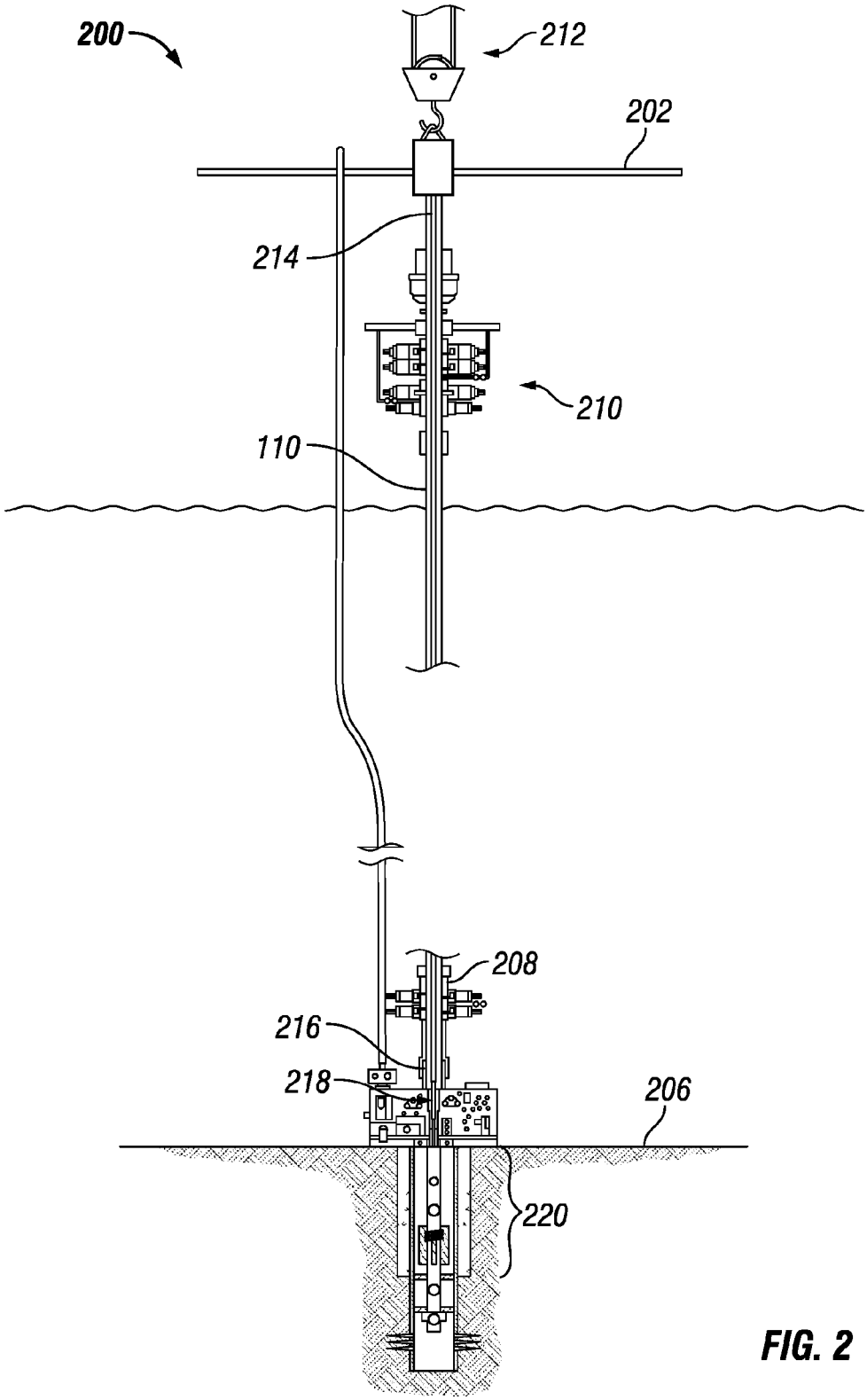
FIG. 2 illustrates of an embodiment of a well completion system with a tubing hanger running tool assembly.

Turning to the drawings, FIG. 2 illustrates an embodiment of a passive motion compensated subsea well system 200 of the disclosure. A rig floats at the surface of the sea having a rig floor 202. A marine riser 110 is suspended below the rig floor 202 and extends proximate to the sea floor 206 and is attached to a containment device 208, such as an MCD (shown). The marine riser 110 can be a high pressure marine riser or a low pressure marine riser. In certain exemplary embodiments, a containment device 208 is attached to a wellhead assembly 218, such as an HXT (shown), which is located on the sea floor 206. If an MCD is used at the seafloor as the containment device 208, a surface BOP 210 is also installed. Otherwise, if the containment device 208 at the sea floor 206 is a subsea BOP 106, no additional surface BOP 210 may be needed.

A drawworks or top drive 212, which is actively heave compensated, is located on top of the rig floor 202. The drawworks is indirectly connected to an upper tubing 214 which descends through the inside of the marine riser 110 and is independent of the marine riser 110. That is, the upper tubing 214 is not coupled to or attached to the marine riser 110 and, instead, floats inside of it. The upper tubing 214 can be a landing string or drill pipe, for example. A tubing hanger running tool assembly 216 is coupled to the upper tubing 214 near the sea floor 206. The tubing hanger running tool assembly 216 includes a tubing hanger running tool. The tubing hanger running tool is attached to a tubing hanger, which, once landed, is attached to the wellhead assembly 218. An upper completion 220 is attached to the tubing hanger, which hangs the upper completion 220 into the well beneath the sea floor 206.

Tubing Hanger Running Tool Assembly

Figure 3:
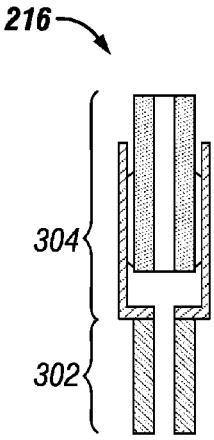
FIG. 3 is an illustration of an embodiment of a simple tubing hanger running tool assembly with passive heave compensation.
Figure 4:
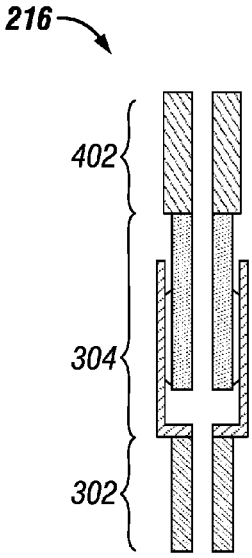
FIG. 4 is an illustration of an embodiment of a tubing hanger running tool assembly including a ported slick joint.
Figure 5:
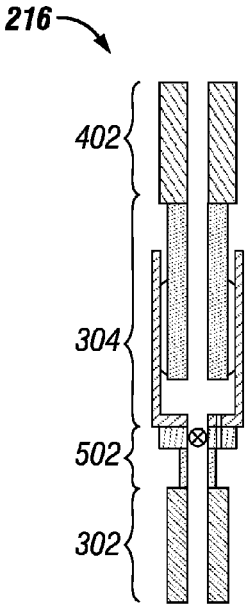
FIG. 5 is an illustration of an embodiment of a tubing hanger running tool assembly including an integral internal test tool.

Cross section illustrations of embodiments of the tubing hanger running tool assembly 216 are shown in FIGS. 3-5. FIG. 3 illustrates the simplest embodiment which comprises a tubing hanger running tool 302 attached to a pressure containing slip joint 304. The tubing hanger running tool assembly 216 can also include a ported slick joint 402 (FIG. 4), an integral internal test tool 502 (FIG. 5), shearable joints, and/or spacers (not shown). It should be noted that if the tubing hanger running tool assembly 216 includes a ported slick joint 402, the integral internal test tool 502, shearable joints, and/or spacers—the pressure containing slip joint 304, the slick joint, the integral internal test tool 502, shearable joint, and/or the spacers can be arranged in any order. However, the tubing hanger running tool 302 is always located at one end of the tubing hanger running tool assembly 216. For example, if the tubing hanger running tool assembly 216 includes a tubing hanger running tool 302, a pressure containing slip joint 304, and a slick joint, the tubing hanger running tool assembly 216 can be attached in the following orders: running tool-slip joint-slick joint;

and running tool-slick joint-slip joint. Spacers and/or shearable joints can be included within the tubing hanger running tool assembly 216 in order to properly space the tools when landed.

In embodiments of the disclosure, the tubing hanger running tool assembly 216 is 5-45 feet long. In certain embodiments of the disclosure, the tubing hanger running tool assembly 216 is 5-20 feet long, 20-46 feet long, 5-15 feet long, 15-30 feet long, 30-45 feet long, 5-10 feet long, 10-15 feet long, 15-20 feet long, 20-25 feet long, 25-30 feet long, or 30-45 feet long. In embodiments of the disclosure, the pressure containing slip joint 304 is 2-44 feet long. In certain embodiments of the disclosure, the pressure containing slip joint 304 is 2-20 feet long, 20-44 feet long, 2-15 feet long, 15-28 feet long, 28-44 feet long, 2-5 feet long, 5-10 feet long, 10-20 feet long, 20-30 feet long, 5-25, 5-30 feet long, or 30-44 feet long. In embodiments of the disclosure, the pressure containing slip joint has 3-35 feet of extension and compression. In specific embodiments, the pressure containing slip joint has 3-10, 10-20, 20-35, 3-5, 5-10, 10-15, 15-20, 20-25, 25-30, or 30-35 feet of extension and compression.

Figure 6:
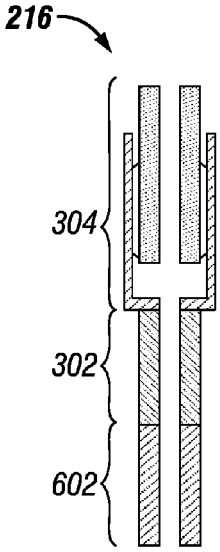
FIG. 6 is an illustration of an embodiment of a tubing hanger running tool assembly attached to a tubing hanger.

The lower end of the tubing hanger running tool assembly 216, primarily the tubing hanger running tool 302, is configured to be releasably attached to a tubing hanger 602 (FIG. 6). The exterior of the tubing hanger 602 is configured to be attached to a tree or tubing head spool. The end of the tubing hanger 602 opposite to the tubing hanger running tool 302 is configured to be or is attached to an upper completion 220. Conventionally, the tubing hanger running tool 302 is equipped with moveable pistons, which, when actuated by hydraulic pressure delivered by the inner control umbilical, manipulate companion parts within and outside the tubing hanger 602 which will fully install the locking and sealing capabilities of the tubing hanger 602 to the wellhead assembly 218.

The upper end of the tubing hanger running tool assembly 216 is configured to be attached to an upper tubing 214. The attachment can be through threading, bolting, brackets, shear pins, or the like. The upper tubing 214 can be a landing string, drill pipe, or the like. The tools or spacers in the tubing hanger running tool assembly 216 may also be releasably attachable to each other through threading, bolting, brackets, shear pins, or the like.

Figure 7:
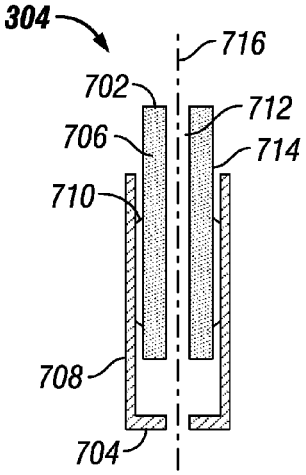
FIG. 7 is an illustration of an embodiment of a pressure containing slip joint.
Figure 8:
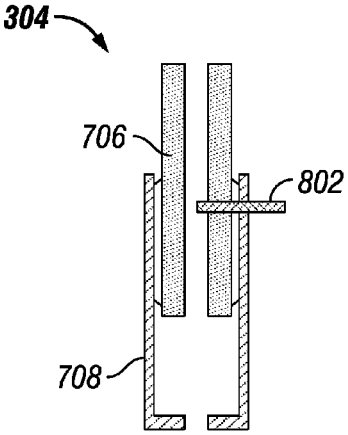
FIG. 8 is an illustration of an embodiment of a fully extended pressure containing slip joint.
Figure 9:
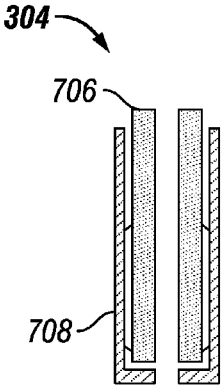
FIG. 9 is an illustration of an embodiment of a fully compressed pressure containing slip joint.

Embodiments of the pressure containing slip joint 304 are shown in FIGS. 7-9. The first end 702 and the second end 704 of the pressure containing slip joint 304 are configured to be attachable to other tools within the tubing hanger running tool assembly 216 or to upper tubing 214 used to run the tubing hanger running tool assembly down from the rig. The attachment can be through threading, bolting, brackets, shear pins or the like. The pressure containing slip joint 304 comprises an inner mandrel 706 and an outer mandrel 708 configured such that the inner mandrel 706 and outer mandrel 708 slide relative to each other along a linear axis 716 providing extension (FIG. 8) and compression (FIG. 9). The inner mandrel 706 and outer mandrel 708 can be configured within the tubing hanger running tool assembly 216 in either direction. That is, the inner mandrel 706 may be located closer to the tubing hanger running tool 302 than the outer mandrel 708, or the slip joint can be flipped such that the outer mandrel 708 is located closer to the tubing hanger running tool 302 than the inner mandrel 706. When the tubing hanger 602 is sealed into the wellhead assembly 218, only the upper mandrel of the pressure containing slip joint 304 moves up and down with the motion of the rig, as the tubing hanger 602 is immobilized with respect to the wellhead assembly 218.

The pressure containing slip joint 304 also comprises seals 710 between the inner mandrel 706 and the outer mandrel 708, such that gas and liquid cannot pass between the inner mandrel 706 and the outer mandrel 708, thus, providing a pressure separation between the interior of the pressure containing slip joint 712 and the exterior of the pressure containing slip joint 714. The seals 710 could be 'o' rings made from material such as Teflon, nitrile, aflas, kalrez, or other such materials. As the slip joint is pressure containing, the interior of the tubing hanger running tool assembly 216 can be kept at a pressure different from the annulus of a marine riser 110 through which the tubing hanger running tool assembly 216 is deployed.

The pressure containing slip joint 304 may also comprise a reversibly latching immobilizing mechanism 802. This latching mechanism stops the movement of the inner mandrel 706 and outer mandrel 708 relative to each other. The latching mechanism may immobilize the mandrels when they are in an extended state (FIG. 8), when they are in a compressed state (FIG. 9), or at any state in between. Embodiments of the latching mechanism include one or more of shear pins, J-latch, hydraulic pistons, and combinations thereof. In some embodiments, as the tubing hanger running tool assembly 216 is deployed, the pressure containing slip joint 304 is latched. When landed, the latching mechanism is released, and the mandrels of the pressure containing slip joint can float with respect to each other providing for passive heave compensation. In one embodiment, the latching mechanism is a shear pin that shears as a result of stress applied after landing the string onto a landing shoulder. The pressure containing slip joint 304 can also comprise a tubing retainer valve, and/or a valve capable of shearing wireline or coiled tubing.

Figure 10:
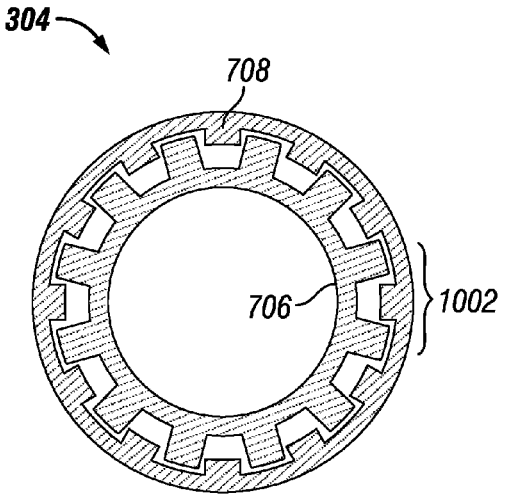
FIG. 10 is an illustration of an embodiment of the inner and outer mandrel comprising splines.
Figure 11:
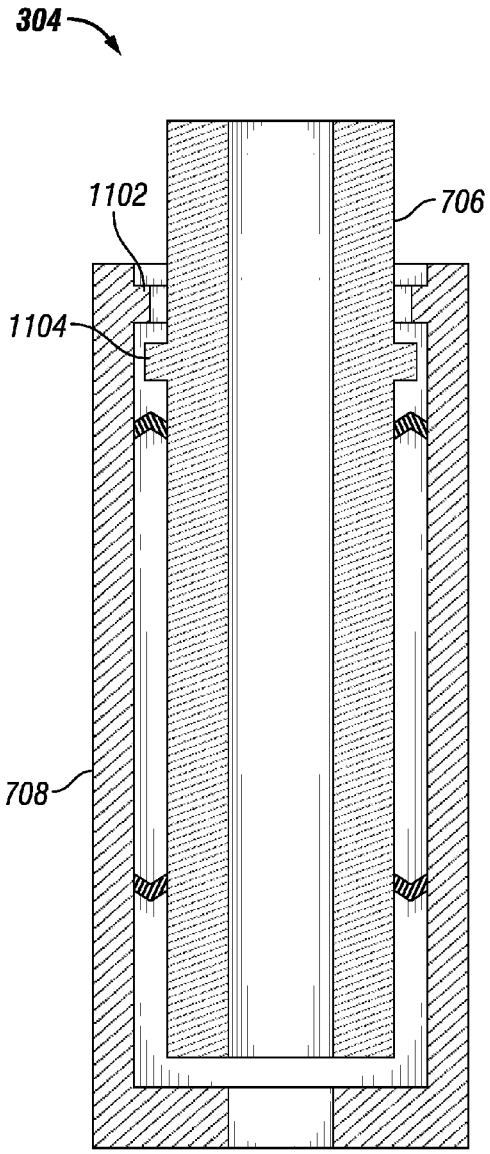
FIG. 11 is an illustration of an embodiment of the inner and outer mandrel comprising ledges and ribs.

In some embodiments, the pressure containing slip joint 304 also comprises axial and/or torsion control, as shown in FIGS. 10 and 11. Axial control can be managed through the geometry of opposing ledges, seating and ribs within the inner mandrel 706 and outer mandrel 708 of the slip joint and is effected by lowering and raising the upper tubing 214 using the rig drawworks or top drive. Torsion control can also be managed through the geometry of opposing ledges, seating and ribs within the inner mandrel 706 and outer mandrel 708 of the slip joint and is effected by rotating the upper tubing 214 using either a top drive suspended from the rig derrick or a rotary table installed as part of the rig floor 202. FIG. 10 illustrates an embodiment of torsional control that uses more than one splined sections 1002; however, just one splined section could also be used. FIG. 11 illustrates an embodiment of axial control of the extension of and latching relatching using ledges 1102 and ribs 1104. The ledges and ribs, and splined sections may be located as needed anywhere along the length of the tool.

In embodiments, the pressure containing slip joint 304 is designed to account for the use of an inner umbilical 116. For example, the pressure containing slip joint 304 may have outside attachments that allow for the inner umbilical 116 to be attached to the pressure containing slip joint 304, while allowing the pressure containing slip joint 304 to move relative to the inner umbilical 116. In some embodiments, the pressure containing slip joint 304 can be configured to allow the expansion and contraction of the pressure containing slip joint 304 without inducing stress on the inner umbilical 116.

Figure 12:
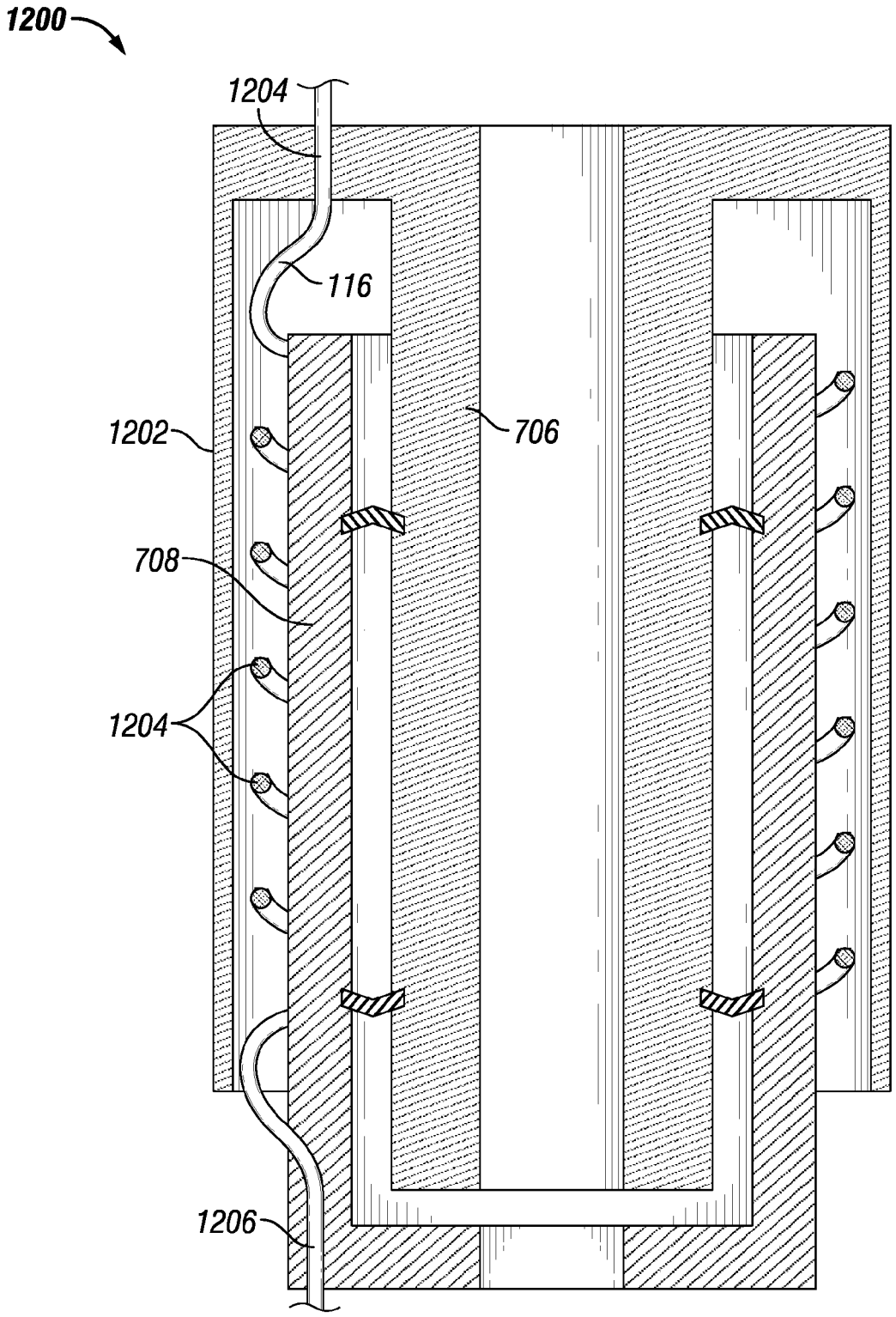
FIG. 12 is an illustration of an embodiment of a ported pressure containing slip joint.

FIG. 12 illustrates one embodiment of the use of an inner umbilical 116 with a ported pressure containing slip joint 1200. In this embodiment, an outer shroud 1202 is attached to the inner mandrel 706 and extends exterior of the outer mandrel 708. An inner mandrel inner umbilical port 1204 then runs into the annulus between the outer mandrel 708 and the outer shroud, coiling (inner umbilical coils 1204) around the outer mandrel 708 and exiting the bottom of the apparatus through an optional outer mandrel inner umbilical port 1206. In embodiments, the inner umbilical 116 comprises a steel tubing that acts as a spring around the outer mandrel. In other embodiments, the inner umbilical 116 runs in a serpentine fashion up the side of the ported pressure containing slip joint.

Embodiments of the tubing hanger running tool assembly 216 additionally comprise an integral internal test tool 502. The integral internal test tool 502 provides the ability to apply test pressure to the top of the tubing hanger 602 and ITC, without pressurizing the entire marine riser 110. The integral internal test tool 502 can accommodate any downhole control/monitor functions, which in some embodiments includes a mechanically actuated isolation valve and a test port. In some embodiments, the integral internal test tool 502 may be designed to fit in the profile of a lower housing of a MCD.

In some embodiments, the tubing hanger running tool assembly 216 is attached to a tubing hanger 602. When running the assembly down from the rig, in this embodiment, the tubing hanger 602 is attached to the tubing hanger running tool assembly 216 below the assembly. A tubing hanger 602 can comprise one or more of a soft landing buffer, an adapter, and crown plugs. In certain embodiments, the tubing hanger 602 achieves a lock and annular seal to a wellhead assembly through hydraulic pressure delivered by an inner umbilical 116 connected through either a subsea test tree (SSTT 104) or 'Land and Lock' (L&L) system to a tubing hanger running tool 302. Pressure testing of the tubing hanger 602 and seals 710 can be accomplished using annulus test tools, internal test tools, BOP, IWOCS, and/or an ROV.

A ported slick joint 402 or shearable joint can be included in the tubing hanger running tool assembly 216. Use of a ported slick joint 402 allows for control lines (inner umbilical 116) to be fed through it and into the top of the tubing hanger running tool 302 for hydraulic control. The ported slick joint 402 or shearable joint, when landed, is located inside of the containment device 208, such that the ported slick joint 402 or shearable joint is shearable by the containment device 208 in an emergency.

In some embodiments, the tubing hanger running tool assembly 216 additionally comprises one or more spacers, which correctly space the tools within the tubing hanger running tool assembly 216 when landed. A spacer can include running string, drill pipe, or a specifically designed length of tubing. For example, if the tubing hanger 602 is to be positioned in a well with a subsea BOP 106, a spacer may be placed between the tubing hanger running tool 302, ported slick joint 402, and the pressure containing slip joint 304 such that when the tubing hanger running tool has properly positioned the tubing hanger 602 at its final position, the pressure containing slip joint 304 is located in the marine riser 110 above the subsea BOP 106.

Passive Motion Compensated Subsea Well System

As described previously, FIG. 2 illustrates an embodiment of a passive motion compensated subsea well system 200. When mobilized, the pressure containing slip joint 304 within the tubing hanger running tool assembly 216 imparts passive motion compensation in the inner string. As the rig moves up due to sea swell, the pressure containing slip joint 304 can extend. When the rig moves down with the motion of the sea, the pressure containing slip joint 304 can contract. While FIG. 2 illustrates the use of the tubing hanger running tool assembly 216 with a subsea MCD, surface BOP 210, and a HXT, many other configurations are possible.

A general embodiment of a passive motion compensated subsea well completion system includes a marine riser 110 suspended below a rig floor 202 and coupled to a containment device 208, a wellhead assembly 218 coupled to the containment device 208 proximate to the top of the wellhead assembly 218, and a tubing hanger running tool assembly 216 suspended from the rig within the marine riser 110. Standard components of a subsea well system can be swapped in and out as needed as described below.

Figure 13:
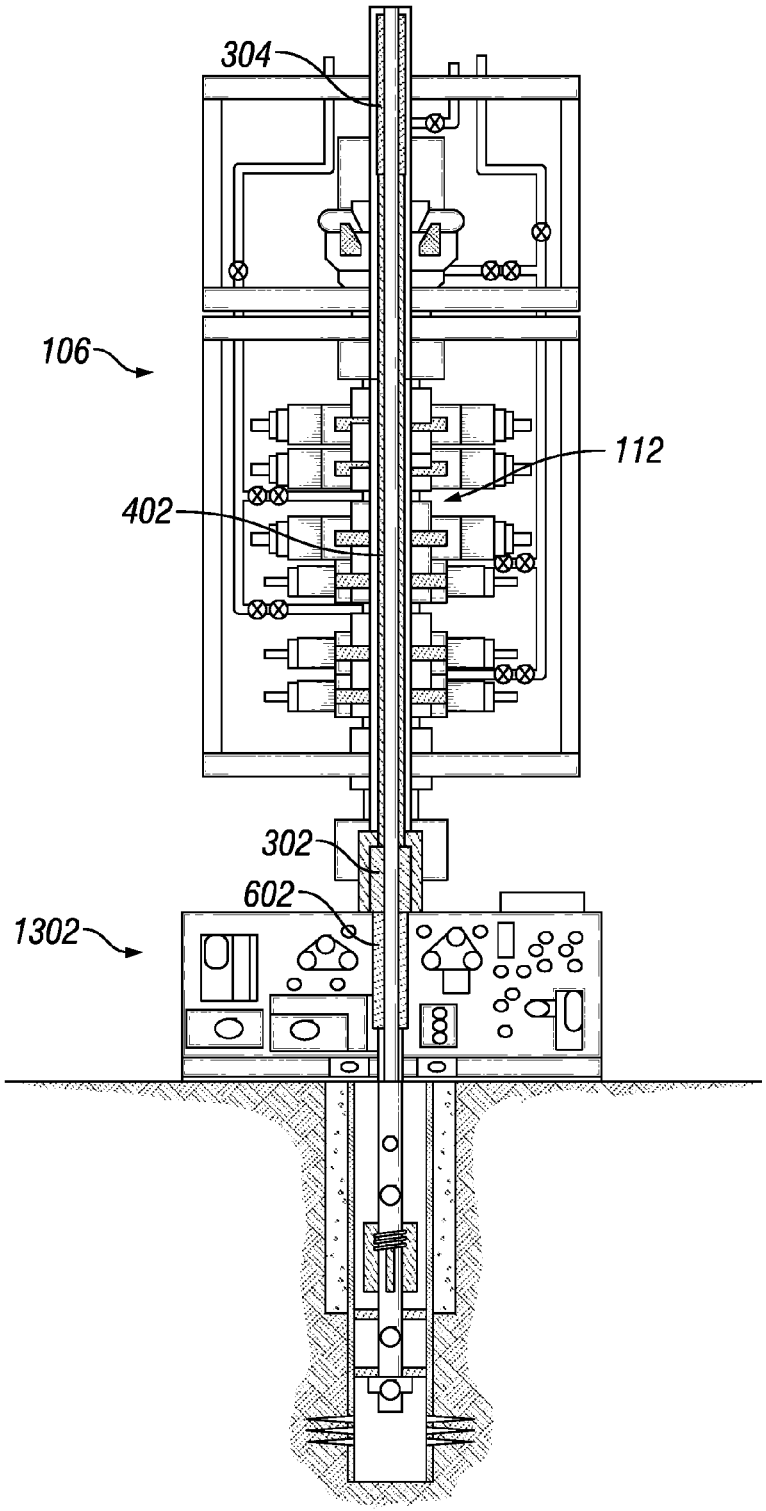
FIG. 13 is an illustration of an embodiment of a tubing hanger running tool assembly landed within a subsea BOP and a HXT.

The containment device 208 can be a BOP or MCD, for example. In some embodiments, if the containment device 208 is a MCD, a surface BOP 210 is installed underneath the rig floor 202. FIG. 13 illustrates an embodiment of the system which uses a subsea BOP 106 as the containment device 208. In this embodiment, the tubing hanger running tool assembly 216 comprises, from top to bottom, a pressure containing slip joint 304, shearable slick joint or ported slick joint 402, and a tubing hanger running tool 302. The shearable slick joint or ported slick joint 402 runs between the blind/shear rams 112, such than if the subsea BOP 106 is activated, the inner string is cleanly sheared. The tubing hanger running tool assembly 216 is shown landed with the tubing hanger 602 sealed to the HXT 1302.

Figure 14:
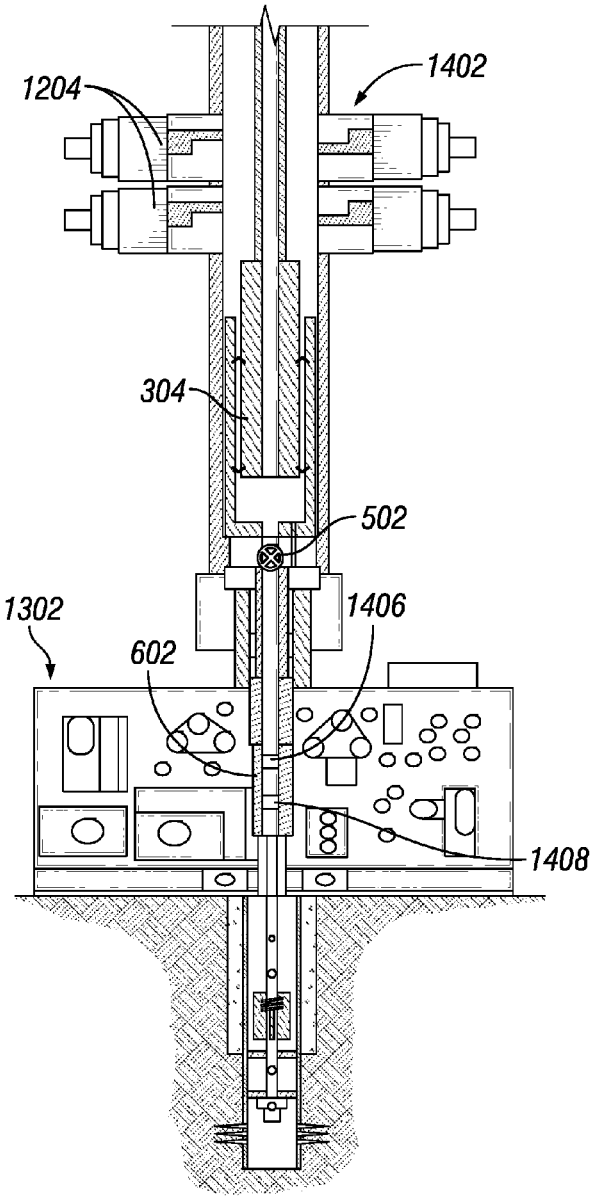
FIG. 14 is an illustration of an embodiment of a tubing hanger running tool assembly landed within a MCD and a HXT.

FIG. 14 illustrates an embodiment where the containment device 208 is a MCD 1402 comprising a containment mechanism 1204. The containment mechanism of the MCD 1402, such as a series of rams, can close across from each other and shear the pipe located within it, stopping the flow of liquid or gas within the pipe. In FIG. 14, the MCD 1402 is designed with an extended bottom length in order to fit the pressure containing slip joint 304 under the containment mechanism 1204 of the MCD 1402. For example, the MCD 1402 can have an extra 5-45 feet of length under the containment mechanism to fit the tubing hanger running tool assembly 216 including the pressure containing slip joint 304. In this way, the MCD 1402 can shear the pipe above the pressure containing slip joint 304 without breaking the pressure containing slip joint 304. After a shearing event, the upper mandrel can be removed and replaced, making recovery from such an event easier. In other embodiments, the MCD 1402 can be of normal length with a ported slick joint 402 or shearable slick joint running inside of it, while the pressure containing slip joint 304 is located above the MCD 1402. FIG. 14 is shown with an HXT 1302 as part of the wellhead assembly 218. An upper crown plug 1406 and a lower crown plug 1408 are installed within the tubing hanger 602.

In some embodiments, a subsea MCD 1402 may be used in conjunction with a surface BOP 210. In specific embodiments, the marine riser 110 connecting the surface BOP 210 with the subsea MCD 1402 is a high pressure marine riser. The MCD 1402 can be attached to the top of a high pressure wellhead or HXT 1302 and subsequently tested. The high pressure wellhead can be positioned in a conductor wellhead housing that is at or near the seafloor. Running the high pressure wellhead and the MCD 1402 to the seafloor in a single run can reduce time and cost associated with typical multiple runs. Additionally, having a high pressure marine riser eliminates the need for a SSTT 104 to provide high pressure well control in conjunction with the surface BOP 210 during flowback operations.

Figure 15:
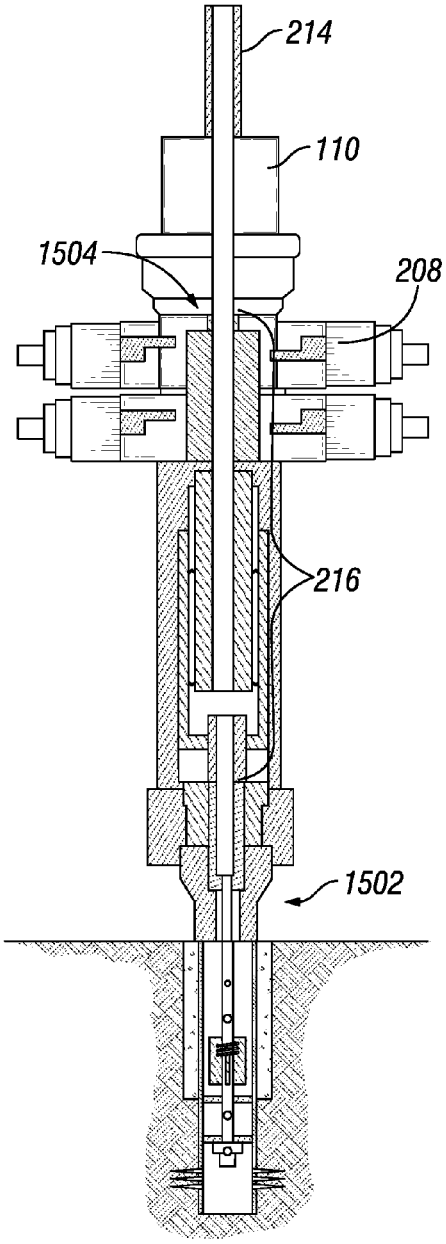
FIG. 15 is an illustration of an embodiment of a tubing hanger running tool assembly landed within a MCD and a high pressure wellhead.

Embodiments of the disclosure can include the use of a VXT or a HXT 1302 within the subsea well system. For example, FIG. 14 illustrates the use of a HXT 1302 with an embodiment of the tubing hanger running tool assembly 216, while FIG. 15 illustrates the use of a high pressure wellhead 1502, which will eventually be attached to a VXT, with the tubing hanger running tool assembly 216. The type of tree can determine the type of tubing hanger 602 to be attached to the tubing hanger running tool assembly 216 and the spacing between the parts of the tubing hanger running tool assembly 216. In some embodiments using a HXT 1302 as illustrated by FIG. 14, a MCD 1402 will be installed as the containment device 208 and a surface BOP 210 is installed at the surface. In this embodiment, the system can accommodate running the tubing hanger 602 with the upper crown plug 1210 and the lower crown plug 1212 already installed and/or tested for their sealing capability.

Some embodiments of the disclosure can include the use of an annulus pressure test device 1504 in the marine riser 110 instead of an integral internal test tool 502 coupled to the tubing hanger running tool assembly 216, as illustrated in FIG. 15. The integral internal test tool 502 can comprise a pressure test port and/or a mechanically actuated isolation valve, including types of valves capable of shearing wireline and/or coiled tubing. Note that the choice between an annulus pressure test device 1504 and an integral internal test tool 502 is independent of other configuration choices, such as the choice of VXT vs HXT 1302.

Methods of Using the System and Apparatus

Figure 16:
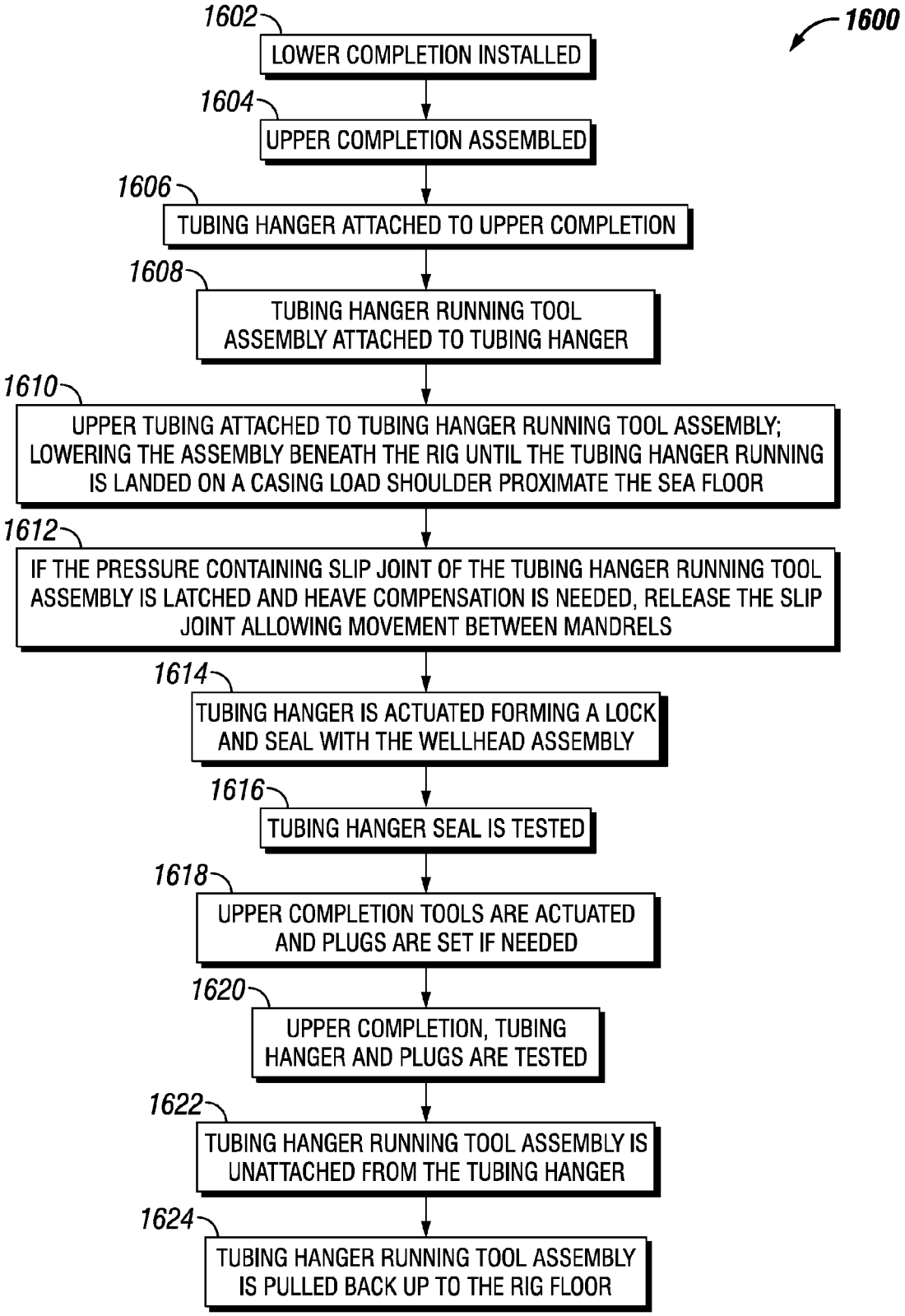
FIG. 16 is a flow chart illustrating a general method of the disclosure using a tubing hanger running tool assembly.

Some general steps are common to all subsea well upper completion jobs 1600 which use the tubing hanger running tool assembly 216, as shown in the flowchart of FIG. 16. The inner string comprising the upper completion 220 is assembled sequentially on the rig floor 202 and lowered down as the next element is attached, thus, creating the inner string. That is, each attachment described in FIG. 16 is done on the rig and the attached item is then lowered and the next item is attached to the previous. The tools and tubing that will go deepest into the well are assembled first with upper tubing 214 installed last, wherein each attachment slightly lowers the first attached item further towards the seafloor and into the well. It should also be noted that the methods of the current disclosure vary from current practice, as a SSTT 104 is not needed in the inner string, and CCTLF 102 does not need to be installed on the rig for passive heave control.

An upper well completion job is started only after the lower completion has been installed 1602. In step 1604, the upper completion 220 is assembled first, and will generally include one or more of production tubing, seal assemblies, downhole control and monitoring devices, and/or packers as necessary. Each tool or tubing piece is assembled as part of the inner string and lowered into the marine riser 110 as the tools and tubing are attached to each other creating the inner string, as described above.

A tubing hanger 602 is then attached in step 1606 to the top of the upper completion 220 and a tubing hanger running tool assembly 216, as described herein, is attached to the tubing hanger 602 in step 1608. Upper tubing 214 is attached in step 1610 to the tubing hanger running tool 302 until the inner string is long enough that the tubing hanger 602 lands on a casing load shoulder and orientation sleeve within a wellhead assembly 218 in step 1610. If the pressure containing slip joint 304 is latched, the latch can be reversed at this step if needed to establish passive heave compensation functionality, allowing the upper mandrel and seal assembly to float freely within the lower mandrel in step 1612.

Once the tubing hanger 602 is landed on the casing load shoulder, the tubing hanger 602 is actuated in step 1614 forming a lock and seal between the tubing hanger 602 and wellhead assembly 218. The tubing hanger 602 seal is tested in step 1616. As needed, upper completion tools are actuated and plugs are set in step 1618. In step 1620, the upper completion 220 and tubing hanger 602 are tested, and if the string passes the testing, the tubing hanger running tool 302 is unattached from the tubing hanger 602 in step 1622, and the tubing hanger running tool assembly 216 is pulled back up to the rig in step 1624, leaving the tubing hanger 602 and upper completion 220 in place, and the well plugged.

While the above steps are done generally to set the upper completion 220 and tubing hanger 602, the specifics of each step vary depending on the configuration of the well system. For example, the following well configurations can change how each specific step is accomplished. Additional steps may also be needed depending on how the well is configured or designed.

1) Use of a VXT or HXT 1302, and 2) use of a surface BOP 210 with MCD 1402 or subsea BOP 106.

Combinations of these different well configurations are possible. Other configurations of the system are also possible, and the general methods using the above configurations are described in more detail below.

Running an Upper Completion with a VXT

The method of running an upper completion 220 using a VXT adds additional steps specific to using a VXT. For example, instead of already having the tree installed, a high pressure wellhead or tubing head spool may be attached directly to a containment device 208 (FIG. 15), such as a subsea BOP 106 or MCD 1402. The tubing hanger 602 is then locked and sealed into the high pressure wellhead or tubing head spool, instead of directly into a tree. After the well is tested for isolation within the casing and the upper completion 220, the containment device 208 and marine riser 110 can be removed. After removal of the containment device 208, a VXT can then be attached to the wellhead.

Running an Upper Completion with an HXT

The method of running an upper completion 220 using a HXT 1302 can add additional steps specific to the HXT 1302. For example, HXT 1302 is attached to the wellhead on the bottom of the HXT 1302 and containment device 208 on the top of the HXT 1302 prior to running the tubing hanger running tool assembly 216. Additionally, 'crown' plugs may be preinstalled within the tubing hanger 602 prior to be being run into the well. After landing the tubing hanger 602, the tubing hanger 602 is then locked and sealed into the HXT 1302. After the well is tested for isolation within the casing and the upper completion 220, the containment device 208 and marine riser 110 can be removed leaving the HXT 1302 in place. If 'crown' plugs are not run pre-installed as part of the tubing hanger 602, this step is preceded with steps to install the 'crown' plugs in the tubing hanger 602.

Additional Method Steps

Depending on the well configuration, additional steps may be added to the method. In some embodiments, viscous fluid pills are circulated into the completion fluid column to mitigate settling of wellbore debris into the lower completion prior to installation of the lower completion and/or after the tubing hanger 602 is sealed. Additionally, after the tubing hanger 602 is sealed, completion fluids may be replaced in the wellbore with treated packer fluid.

Although some embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures. One of ordinary skill in the art will appreciate that in the development of any such actual embodiment, numerous implementation-specific decisions must be made to achieve the developers' specific goals, such as compliance with system-related constraints, which will vary from one implementation to another. Moreover, it will be appreciated that such a development effort might be complex and time-consuming, but would nevertheless be a routine undertaking for those of ordinary skill in the art having the benefit of this disclosure.

What is claimed is:

1. A method of running a tubing hanger and upper completion using a tubing hanger running tool assembly in a subsea well located at a sea floor comprising:

assembling an inner string comprising, from bottom up:

an upper completion assembly comprising one or more of the following parts: production tubing, seal assemblies, safety valves, and packers;

a tubing hanger;

the tubing hanger running tool assembly comprising a tubing hanger running tool coupled to a pressure containing slip joint that imparts passive motion compensation; and drill pipe or landing string;

lowering the inner string into a marine riser until the tubing hanger is landed on a casing load shoulder proximate the sea floor; and actuating the tubing hanger running tool assembly to seal the tubing hanger to a wellhead assembly.

2. The method of claim 1, wherein the tubing hanger running tool assembly further comprises a shearable slick joint.

3. The method of claim 1, wherein the pressure containing slip joint further comprises a latching mechanism configured to stop compression and extension of the slip joint.

4. The method of claim 3, wherein the slip joint is immobilized by the latching mechanism as the string of tools is lowered.

5. The method of claim 4, wherein just prior, during, or just after landing, the latching mechanism is released.

6. The method of claim 1, wherein an inner umbilical is attached to the outside of the inner string as the inner string is being assembled.

7. The method of claim 6, wherein the tubing hanger is actuated utilizing the inner umbilical.

8. The method of claim 6, wherein the inner umbilical is utilized to activate testing tools.

9. The method of claim 6, wherein the inner umbilical is utilized to receive and/or transmit testing data.

10. The method of claim 1, further comprising, after actuating the tubing hanger, testing the seal of the tubing hanger.

11. The method of claim 10, wherein the seal is tested using one or more of a BOP, an integral internal test tool, an annular pressure test tool, and combinations thereof.

12. The method of claim 1, further comprising setting one or more plugs and backpressure valves within the inner string using a wireline.

13. The method of claim 12, further comprising testing the one or more plugs and backpressure valves.

14. The method of claim 1, further comprising actuating parts of the upper completion.

15. The method of claim 1, further comprising, after actuating the tubing hanger, disconnecting the tubing hanger running tool assembly from the tubing hanger.

16. The method of claim 15, wherein, after disconnection, the tubing hanger running tool assembly is pulled back up to a rig.

17. The method of claim 15, wherein the pressure containing slip joint is latched prior to disconnecting the tubing hanger running tool assembly from the tubing hanger.

18. The method of claim 1, wherein the wellhead assembly comprises a HXT.

19. The method of claim 1, wherein the wellhead assembly comprises a high pressure wellhead.

20. The method of claim 1, wherein the tubing hanger has crown plugs installed during the assembly of the inner string.

21. The method of claim 1, wherein a containment device is attached between the wellhead assembly and the marine riser proximate the sea floor.

22. The method of claim 21, wherein the containment device is a BOP.

23. The method of claim 21, wherein the containment device is a MCD and a surface BOP is installed.

24. The method of claim 23, wherein the MCD is 5-45 feet long.

25. The method of claim 21, wherein the tubing hanger running tool assembly further comprises a ported slick joint.

26. The method of claim 25, wherein when landed, the ported slick joint is located within the containment device.

27. The method of claim 1, wherein the tubing hanger running tool assembly is 5-45 feet long.

28. The method of claim 1, wherein an annulus between the marine riser and the inner string is at a different pressure than the inside of the inner string.

* * * * *